US005229741A

United States Patent [19]

Black, III

[11] Patent Number: 5,229,741

[45] Date of Patent: Jul. 20, 1993

[54] AUTOMOTIVE RESISTOR UNIT HAVING MOUNTING CLIP

[75] Inventor: Charles E. Black, III, Mount Prospect, Ill.

[73] Assignee: Indak Manufacturing Corp., Northbrook, Ill.

[21] Appl. No.: 896,067

[22] Filed: Jun. 9, 1992

[51] Int. Cl.[5] ..... H01C 13/00

[52] U.S. Cl. ..... 338/50; 338/51

[58] Field of Search ..... 338/51, 50; 165/42, 165/43, 12; 337/297

[56] References Cited

U.S. PATENT DOCUMENTS 3,372,307 3/1968 Bedocs .

4,306,213 12/1981 Rose ..... 337/297

4,935,717 6/1990 Osawa et al. ..... 338/51

*Primary Examiner*—Marvin M. Lateef

*Attorney, Agent, or Firm*—Palmatier & Zummer

[57] ABSTRACT

The resistor unit comprises resistors connected to electrical terminals secured to an insulating plate to which first and second legs of a spring sheet metal mounting clip are secured for insertion through an opening in a supporting wall. The legs are bent forwardly from a rear member and are formed with first and second spring latching members including ramp portions bent laterally from the legs, shoulder portions bent inwardly from the ramp portions for wedging engagement with edge portions of the wall, and front end portions bent forwardly from the inner ends of the shoulder portions. A soft resilient expanded rubber gasket is mounted on the plate for sealing engagement with a rib projecting forwardly from the wall around the opening. The spring force produced by compression of the gasket is counterbalanced by the wedging action of the shoulder portions, so that rattling is prevented. The legs are inserted with an interference fit into opposite end portions of the opening. The rear clip member and the opening have similar nonsymmetrical shapes affording unique orientation of the resistor unit. The clip also protects the resistors from damage during shipment.

21 Claims, 5 Drawing Sheets

AUTOMOTIVE RESISTOR UNIT HAVING MOUNTING CLIP

FIELD OF THE INVENTION

This invention relates to automotive resistor units for regulating the speed of a blower motor in an automotive heating and ventilating system which may also include air conditioning.

BACKGROUND OF THE INVENTION

Heretofore, resistor units have been employed as components of switching systems for adjusting the speed of blower motors for automotive heating and ventilating systems which may also include air conditioning. In a known resistor unit construction, several resistors are connected to and supported by electrical terminals mounted on a terminal head plate. The terminals generally have prongs or lugs which extend forwardly through the plate for receiving an electrical receptacle or connector, whereby the resistors are connected into a switching circuit for selectively connecting the resistors in series with a blower motor for reducing the speed of the motor.

Typically, the resistor unit is mounted on a supporting wall which constitutes one wall of the blower casing or a wall of a duct through which air is directed by the blower. The resistors extend through an opening in the supporting wall and are positioned in the blower casing or a duct connected to the casing, so that the resistors are immersed in the flow of air from the blower. In this way, the resistors are cooled by the flow of air, and the air is heated to some extent by the resistors.

The prevailing practice has been to employ screws or other fasteners to secure the terminal head plate of the resistor unit to the supporting wall. However, the use of such fasteners has the disadvantage that a fastener is sometimes dropped into the blower casing or duct through the opening therein. As a worst case, a dropped fastener may become lodged between the casing wall and the rotor or wheel of the blower, so that the rotor is locked and becomes inoperative. In this case, an expensive repair must be made to locate and remove the offending fastener.

Even if the fastener falls into a harmless place in the blower casing, the retrieval of the fastener may be very difficult so that the installer will not remove the dropped fastener. In that case, the dropped fastener will produce an annoying rattle throughout the life of the vehicle in which the blower is installed.

OBJECTS OF THE INVENTION

One object of the present invention is to provide a new and improved resistor unit which is constructed and arranged so as to obviate any need for screws or other similar fasteners to mount the resistor unit on a supporting wall.

A further object is to provide a new and improved resistor unit of the foregoing character having a mounting clip adapted to be inserted through an opening in the supporting wall for securely mounting the resistor unit on the supporting wall.

A further object is to provide such a new and improved resistor unit in which the mounting clip and the supporting wall are constructed and arranged so as to obviate any possibility of accidental detachment of the resistor unit from the supporting wall.

Still another object is to provide a new and improved resistor unit of the foregoing character in which the mounting clip and the supporting wall are constructed and arranged so as to obviate any rattling of the resistor unit relative to the supporting wall.

SUMMARY OF THE INVENTION

To achieve the foregoing objects, the present invention preferably provides a resistor unit for regulating the speed of an automotive blower motor, the resistor unit comprising an insulating terminal head plate, a plurality of electrical terminals mounted on the rear side of the plate, at least some of the terminals having prongs extending forwardly from the plate for establishing electrical connections to the terminals, a plurality of resistors connected between the terminals and disposed to the rear of the plate, and a generally U-shaped mounting clip secured to the rear side of the plate and made of flexible resilient spring sheet metal, the clip partially surrounding the resistors and providing a guard for the resistors, the clip having a rear member generally parallel with the plate and spaced to the rear of the plate, the clip having first and second legs bent forwardly from opposite ends of the rear member, the legs having means for securing the front ends of the legs to the plate, the clip including first and second spring latching members formed in one piece with the first and second legs and struck from the sheet metal thereof, the spring latching members having ramp portions bent laterally outwardly from the legs near the rear ends thereof and slanting laterally outwardly at small acute angles from the legs, the legs having longitudinal slots therein resulting at least in part from the striking of the spring latching members from the legs, the first and second spring latching members having first and second shoulder portions bent inwardly at slant angles from the front ends of the ramp portions, the respective shoulder portions extending inwardly through the corresponding longitudinal slots in the legs.

Preferably, the first and second spring latching members have respective first and second front end portions bent forwardly from the corresponding shoulder portions and extending generally parallel with the legs.

The resistor unit preferably includes a soft resilient compressible gasket mounted on the rear side of the terminal head plate and extending around the terminals and the mounting clip.

The first and second shoulder portions are preferably bent at substantially right angles relative to the respective ramp portions, the first and second shoulder portions extending at small acute slant angles relative to the direction of the terminal head plate.

Preferably, the first and second legs of the clip are tapered rearwardly between the terminal head plate and the rear member of the mounting clip.

The first and second legs are substantially perpendicular to the terminal head plate and substantially parallel to each other, except that the first and second legs have rear portions which slant rearwardly and inwardly toward each other at a small acute angle.

The rear member of the clip is preferably nonsymmetrical and has a wide main portion and first and second end portions of different widths, the first end portion having a narrow width which is substantially narrower than the width of the main portion, the second end portion having a substantially wider width than the width of the narrow first end portion.

Preferably, the first and second legs connect with the respective first and second end portions of the rear member, the first and second legs having widths which are substantially the same.

By way of further summary, the present invention preferably provides a resistor unit in combination with a supporting wall for the resistor unit, the resistor unit comprising an insulating terminal head plate, a plurality of electrical terminals mounted on the rear side of the plate, at least some of the terminals having prongs extending forwardly from the plate for establishing electrical connections to the terminals, a plurality of resistors connected between the terminals and disposed to the rear of the plate, and a generally U-shaped mounting clip secured to the rear side of the plate and made of flexible resilient spring sheet metal for securely connecting the resistor unit to the supporting wall, the supporting wall having a generally rectangular opening therein for receiving the resistors and the mounting clip, the clip partially surrounding the resistors and providing a guard for the resistors, the clip having a rear member generally parallel with the plate and spaced to the rear of the plate, the clip having first and second legs bent forwardly from opposite ends of the rear member, the legs having means for securing the front ends of the legs to the plate, the rear member being nonsymmetrical in shape, the opening in the wall having a corresponding nonsymmetrical shape for receiving the rear member in a unique orientation, the clip including first and second spring latching members formed in one piece with the first and second legs and struck from the sheet metal thereof, the first and second spring latching members having respective first and second ramp portions bent laterally outwardly from the legs near the rear ends thereof and slanting laterally outwardly at small acute angles from the legs, the legs having longitudinal slots therein resulting at least in part from the striking of the spring latching members from the legs, the first and second spring latching members having first and second shoulder portions bent inwardly from the front ends of the ramp portions at small acute slant angles relative to the longitudinal direction of the plate, the respective shoulder portions extending inwardly through the corresponding longitudinal slots in the legs, the opening in the supporting wall having first and second extreme end portions of a reduced width corresponding with the width of the spring latching members for receiving the spring latching members, the wall having first and second edge portions adjacent the first and second extreme end portions of the opening for engagement by the spring latching members, the first and second spring latching members being flexed inwardly by camming action between the ramp portions and the edge portions when the clip is inserted rearwardly through the opening in the wall, the shoulder portions being engageable with the edge portions in response to further inserting movement of the clip into the opening for securely retaining the clip in the opening.

The shoulder portions preferably extend at small acute slant angles relative to the wall for producing a wedging action between each of the shoulder portions and the corresponding edge portion on the wall.

Preferably, the resistor unit includes a soft resilient compressible gasket on the plate and compressible by engagement with the wall, the compression of the gasket producing a resilient force counterbalanced by the wedging action of the shoulder portions for preventing looseness and rattling of the resistor unit relative to the supporting wall.

The supporting wall preferably includes a rib projecting forwardly from the wall and extending around the opening for sealing engagement with the gasket to compress the gasket.

The gasket is preferably made of expanded rubber.

Preferably, the first and second shoulder portions are bent at substantially right angles relative to the respective ramp portions, the first and second shoulder portions extending at small acute slant angles relative to the direction of the terminal head plate to produce a wedging action between the shoulder portions and the edge portions on the wall.

Preferably, the opening in the supporting wall includes first and second opening portions adjacent the extreme end portions of the opening, the first and second legs of the clip being receivable in the first and second opening portions with an interference fit between each leg and the corresponding opening portion to prevent looseness and rattling of the legs relative to the supporting wall.

Each of the legs preferably has a front portion with a width slightly greater than the width of the corresponding opening portion to produce the interference fit therewith, the first and second legs of the clip being tapered rearwardly in width to provide for easy entry of the first and second legs into the first and second opening portions.

The first and second legs preferably are substantially perpendicular to the terminal head plate and substantially parallel to each other, except that the first and second legs have rear portions which slant rearwardly and inwardly toward each other at a small acute angle, the rear portions of the legs being freely receivable in the opening portions, the legs being positioned to produce frictional engagement between each of the legs and the supporting wall adjacent the opening portions when the legs are fully inserted into the opening portions.

Preferably, the rear member of the clip has a wide main portion and first and second end portions of different widths, the first end portion of the rear member having a narrow width which is substantially narrower than the width of the main portion, the opening in the supporting wall having a narrow portion of a width corresponding with the width of the first end portion of the rear member for receiving the first end portion of the rear member, the second end portion of the rear member having a substantially wider width than the width of the narrow first end portion of the rear member, the opening in the supporting wall having a relatively wide opening portion of a width corresponding with the width of the second end portion of the rear member for receiving the second end portion of the rear member, whereby the rear member is receivable in a unique orientation in the opening in the supporting wall.

Preferably, each of the longitudinal slots in the legs is substantially wider than the corresponding spring latching member to afford ample clearance therebetween.

By way of further summary, the invention preferably provides a resistor unit in combination with a supporting wall for the resistor unit, the resistor unit comprising an insulating terminal head plate, a plurality of electrical terminals mounted on the rear side of the plate, at least some of the terminals having prongs extending forwardly from the plate for establishing electrical connections to the terminals, a plurality of resistors connected between the terminals and disposed to the rear of the plate, and a generally U-shaped mounting clip secured to the rear side of the plate and made of flexible resilient spring sheet metal for securely connecting the resistor unit to the supporting wall, the supporting wall having a generally rectangular opening therein for receiving the resistors and the mounting clip, the clip partially surrounding the resistors and providing a guard for the resistors, the clip having a rear member generally parallel with the plate and spaced to the rear of the plate, the clip having first and second legs bent forwardly from opposite ends of the rear member, the legs having means for securing the front ends of the legs to the plate, the rear member being nonsymmetrical in shape, the opening in the wall having a corresponding nonsymmetrical shape for receiving the rear member in a unique orientation, the clip including first and second spring latching members formed in one piece with the first and second legs and struck from the sheet metal thereof, the first and second spring latching members having respective first and second ramp portions bent laterally outwardly from the legs near the rear ends thereof and slanting laterally outwardly at small acute angles from the legs, the legs having longitudinal slots therein resulting in part from the striking of the spring latching members from the legs, the longitudinal slots being substantially wider than the spring latching members to afford ample clearance for movement of the spring latching members in the slots, the first and second spring latching members having first and second shoulder portions bent inwardly from the front ends of the ramp portions at small acute slant angles relative to the longitudinal direction of the plate, the respective shoulder portions extending inwardly through the corresponding longitudinal slots in the legs, the opening in the supporting wall having first and second extreme end portions of a reduced width corresponding with the width of the spring latching members for receiving the spring latching members, the wall having first and second edge portions adjacent the first and second extreme end portions of the opening for engagement by the spring latching members, the first and second spring latching members being flexed inwardly by camming action between the ramp portions and the edge portions when the clip is inserted rearwardly through the opening in the wall, the shoulder portions being engageable with the edge portions in response to further inserting movement of the clip into the opening for securely retaining the clip in the opening, the shoulder portions extending at small acute slant angles relative to the wall for producing a wedging action between each of the shoulder portions and the corresponding edge portion on the wall, the resistor unit including a soft resilient compressible gasket on the plate and compressible by engagement with the wall, the compression of the gasket producing a resilient force counterbalanced by the wedging action of the shoulder portions for preventing looseness and rattling of the resistor unit relative to the supporting wall.

The supporting wall preferably includes a rib projecting forwardly from the wall and extending around the opening for sealing engagement with the gasket to compress the gasket.

BRIEF DESCRIPTION OF THE DRAWINGS

Further objects, advantages and features of the present invention will appear from the following description, taken with the accompanying drawings, in which.

DETAILED DESCRIPTION OF ILLUSTRATIVE EMBODIMENT

Figure 1:
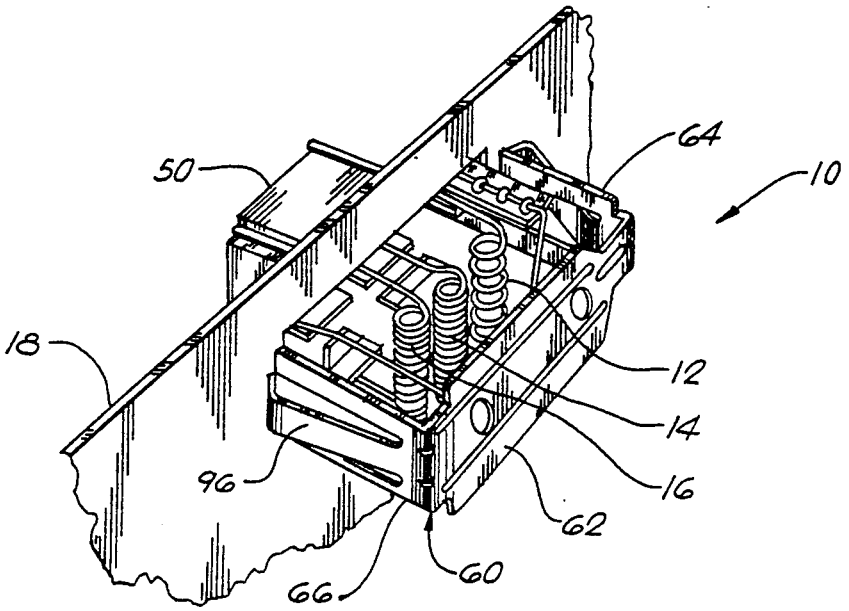
FIG. 1 is a perspective view of a new resistor unit to be described as an illustrative embodiment of the present invention, the resistor unit being shown in its position of use, mounted on a supporting wall and with a portion of the resistor unit extending through an opening in the wall.
Figure 2:
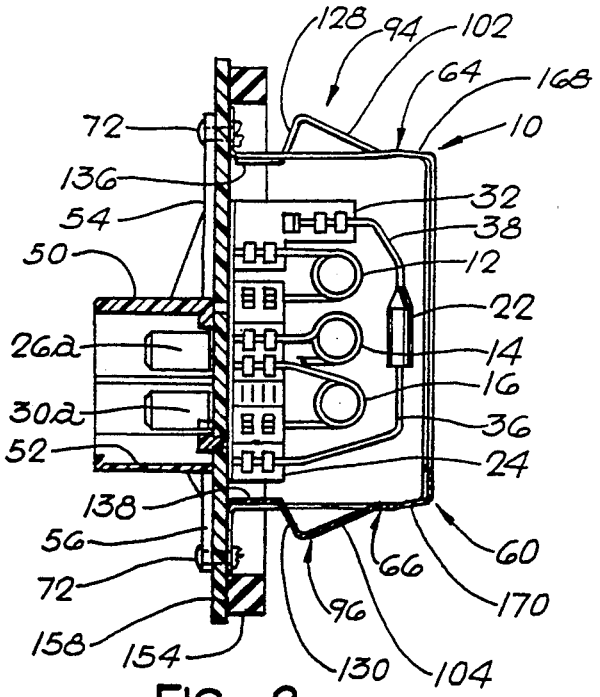
FIG. 2 is a longitudinal side view of the resistor unit, with a portion of the unit shown in a central longitudinal section.

As previously indicated, FIGS. 1 and 2 of the drawings illustrate a resistor unit 10 which will find many applications but is intended primarily for automotive use in connection with an automotive heating and ventilating system which may also include air conditioning. As shown in FIGS. 1 and 2, the resistor unit 10 comprises first, second and third resistors 12, 14 and 16 which are adapted to be connected in series with the electrical motor of a blower or fan, not shown, for blowing air into the cab of an automotive vehicle. The resistors 12, 14 and 16 are employed in a switching circuit for adjusting the speed of the blower motor. Those skilled in the art will be familiar with speed control circuits of this kind.

The resistor unit 10 is adapted to support the resistors 12, 14 and 16 in the blower case or in an air duct extending from the blower, so that the heat generated electrically in the resistors will be transferred to the air stream from the blower. FIG. 1 includes a fragmentary showing of a wall 18 which is one wall of the blower case. Portions of the resistor unit extend into the case through an opening or slot 20 in the wall 18.

The resistor unit also comprises a thermal fuse or circuit breaker 22 adapted to open or interrupt the electrical supply circuit for the blower motor if an overheating situation develops in the blower case. The fuse 22 and the resistors 12, 14 and 16 are also shown in the electrical circuit diagram of FIG. 18.

As shown in FIGS. 1 and 2, the resistors 12, 14 and 16 are in the form of coils of resistance wire having end wires which are connected to and supported by first, second, third and fourth main terminals 24, 26, 28 and 30, respectively, and a partial or dummy terminal 32. The end wires are connected to the five terminals 24–32 by suitable means, such as the illustrated loops 34, struck from the terminals 24–32. The end wires are inserted into the loops 34, which are then forcibly crushed or crimped, to retain the wires and to establish good electrical contact between the wires and the terminals. The thermal fuse 22 has end wires 36 and 38 which are received and securely retained in certain of the loops 34.

The four main terminals 24, 26, 28 and 30 have terminal prongs or lugs **24*a*, 26*a*, 28*a* and 30*a*, respectively, which extend outwardly through respective first, second, third, and fourth slots 40, 42, 44 and 46, formed in a terminal head or plate 48, made of a suitable electrically insulating material, such as a suitable resinous plastic material. The four main terminals 24–30 and the dummy terminal 32 are riveted or otherwise securely fastened to the terminal head 48. The dummy terminal 32 does not have any external prong or lug but is mounted entirely on the inner or rear side of the terminal head 48**.

Figure 18:
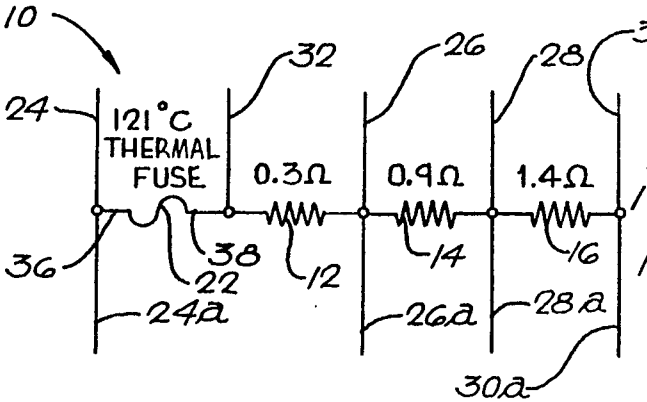
FIG. 18 is a schematic diagram showing the electrical circuit of the resistor unit.

As shown in the electrical circuit diagram of FIG. 18, the thermal fuse 22 has its end leads 36 and 38 connected to the first main terminal 24 and the dummy terminal 32. The first resistor 12 is connected between the dummy terminal 32 and the second main terminal 26. The second resistor 14 is connected between the second and third main terminals 26 and 28. The third resistor 16 is connected between the third and fourth terminals 28 and 30.

The four terminal prongs **24*a*, 26*a*, 28*a* and 30*a* are adapted to engage electrical contacts in a receptacle or connector, not shown, whereby the resistors 12–16 and the fuse 22 are connected into a blower speed control circuit. Thus, for example, the prong 24*a* may be connected to one terminal of a battery, not shown. The prong 30*a* may be connected to one terminal of a blower motor, not shown, having its other terminal connected to the other terminal of the battery. The terminal prongs 24*a*, 26*a*, 28*a* and 30*a* may also be connected to an electrical selector switch, not shown, whereby the resistors 12, 14 and 16** may be selectively short circuited to adjust the operating speed of the blower motor.

Figure 4:
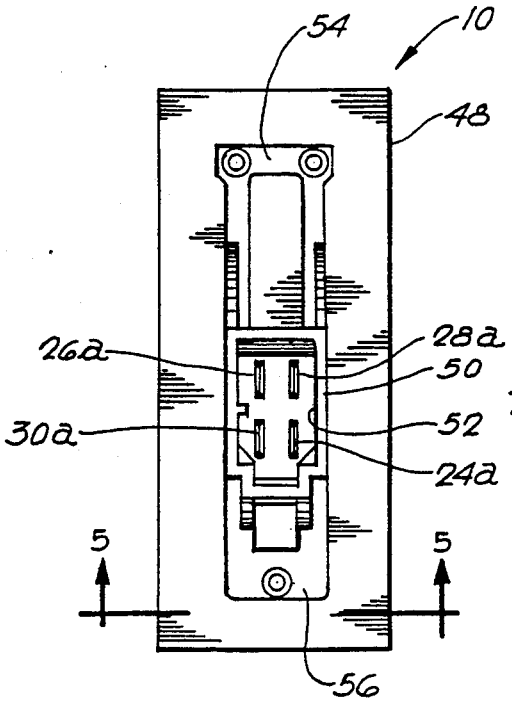
FIG. 4 is a front elevation of the resistor unit.

As shown in FIGS. 1, 2 and 4, the resistor unit 10 is preferably provided with an electrically insulating shell or sleeve 50 which surrounds and protects the outwardly projecting terminal prongs **24*a*, 26*a*, 28*a* and 30*a*. The shell 50 may be made of a suitable resinous plastic material or any other suitable material which is electrically insulating and mechanically strong. The sleeve 50 has a generally rectangular opening 52 therein, adapted to receive the body of the connector or receptacle which is to mate with the terminal prongs 24*a*, 26*a*, 28*a* and 30*a*. The opening 52 is non-symmetrical so that the body of the receptacle will fit in only one position in the opening 52. The shell 50 has opposite end flanges 54 and 56 which are riveted or otherwise securely fastened to the terminal head 48**.

In many prior resistor units, the terminal head 48 would have been secured to the wall 18 by rivets, screws or other similar fasteners. However, the use of such fasteners has various disadvantages. For example, the installation of such fasteners is a labor-intensive and expensive procedure. Moreover, the installer may occasionally drop one or more fasteners through the opening 20 into the blower case, from which the retrieval of the dropped fasteners may be difficult or virtually impossible. The dropped fastener may get into the space between the blower rotor and the case so as to lock the rotor, thereby causing failure of the blower, so that an expensive repair will be necessary. As a minimum, any dropped fastener will cause an annoying rattle in the completed vehicle.

To eliminate any need for fasteners, the illustrated resistor unit 10 is provided with a mounting clip 60, illustrated as being generally U-shaped and preferably bent from a single strip of flexible resilient sheet material, such as spring sheet steel, for example. However, the clip 60 may be made of any other suitable material. As shown, the clip 60 has a substantially straight rear panel or member 62 from which a pair of legs 64 and 66 are bent forwardly, generally at right angles to the rear member 62. Mounting flanges 68 and 70 are bent laterally from the respective legs 64 and 66, generally at right angles thereto, and are adapted to be secured to the terminal head 48 by any suitable means, preferably the illustrated rivets 72.

Although the clip 60 is made of resilient sheet material, it is quite rigid when securely mounted on the terminal head 48. The rear panel or member 62 of the clip 60 is positioned to the rear of the resistors 12, 14 and 16, and also just to the rear of the thermal fuse 22, so that the rear member 62 functions as a shield or guard to protect the components 12, 14, 16 and 20 from mechanical damage, when the resistor unit 10 is shipped or handled prior to its assembly into an automotive vehicle. The stiffness of the rear member 62 is increased by forming ribs 74, 76 and 78 therein.

The rear member 62 of the clip 60 is adapted to be inserted through the opening or slot 20 in the supporting wall 18, during the assembly of the resistor unit 10 on the blower case of an automotive vehicle. The rear member 62 and the opening 20 are somewhat similar in shape and are non-symmetrical, so that the resistor unit 10 must be properly oriented, to enable the rear member 62 to be inserted through the opening 20.

Figure 14:
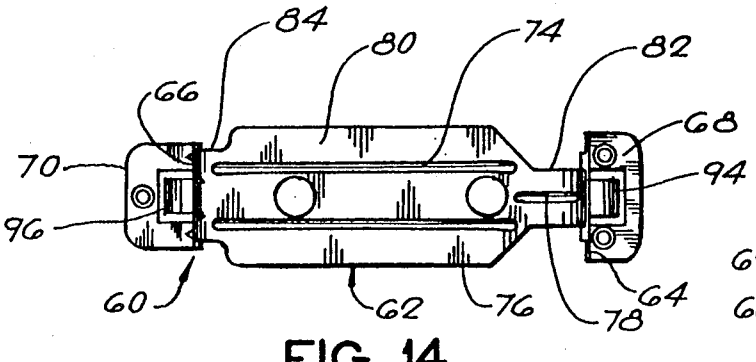
FIG. 14 is a rear elevational view of a mounting clip, constituting another component of the resistor unit.
Figure 16:
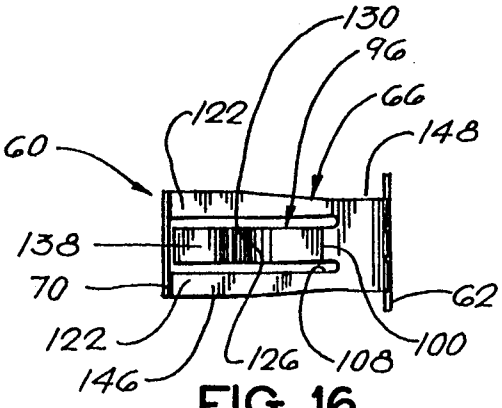

More specifically, as shown in FIG. 14, the rear member 62 of the mounting clip 60 has a wide, generally rectangular main portion 80 which is sufficiently large to form an adequate guard for the resistors 12, 14 and 16 and the fuse 22. At one end of the wide portion 80, the rear member tapers in width to a first end portion 82 of a narrow width, much narrower than the width of the main portion 80. At the opposite end of the main portion 80, the rear member 62 has a second end portion 84 substantially narrower than the main portion 80 but substantially wider than the narrow end portion 82.

The opening or slot 20 in the wall 18 has a generally rectangular main portion 86 which is amply wide to receive the main portion 80 of the rear member 62 of the clip 60. The opening 20 has a first or narrow end portion 88 which is only slightly wider than the first or narrow end portion 82 of the rear member 62, but much too narrow to receive the second or wide end portion 84 of the member 62. At the opposite end of the opening 20, it has a second or wide portion 90 which is narrower than the main portion 86 but wide enough to receive the second or wide end portion 84 of the rear member 62 of the clip 60.

The first and second end legs 64 and 66 of the mounting clip 60 are formed with first and second spring latching members 94 and 96 which are formed in one piece with the clip 60. The spring latching members 94 and 96 may also be characterized as flexible resilient leaf springs connected integrally to the respective legs 64 and 66 at bend lines 98 and 100 where the latching members are bent laterally outwardly from the legs 64 and 66 at a small acute angle to form gradually slanting ramp portions 102 and 104. The spring latching members 94 and 96 are struck from the sheet metal of the respective legs 64 and 66, so that respective slots 106 and 108 are formed in the legs 64 and 66. The slots 106 and 108 are substantially wider than the corresponding spring latching members 94 and 96 so that the spring latching members 94 and 96 are freely swingable in the slots 106 and 108. The formation of the slots 106 and 108 divides the respective legs 64 and 66 into pairs of stationary supporting members 120 and 122.

The respective ramp portions 102 and 104 of the spring latching members 94 and 96 extend forwardly to respective bend lines 124 and 126 from which slanting shoulder portions 128 and 130 are bent inwardly toward and slightly past the corresponding stationary supporting members 120 and 122.

Figures 8, 9, 10, 11, 12, 13:
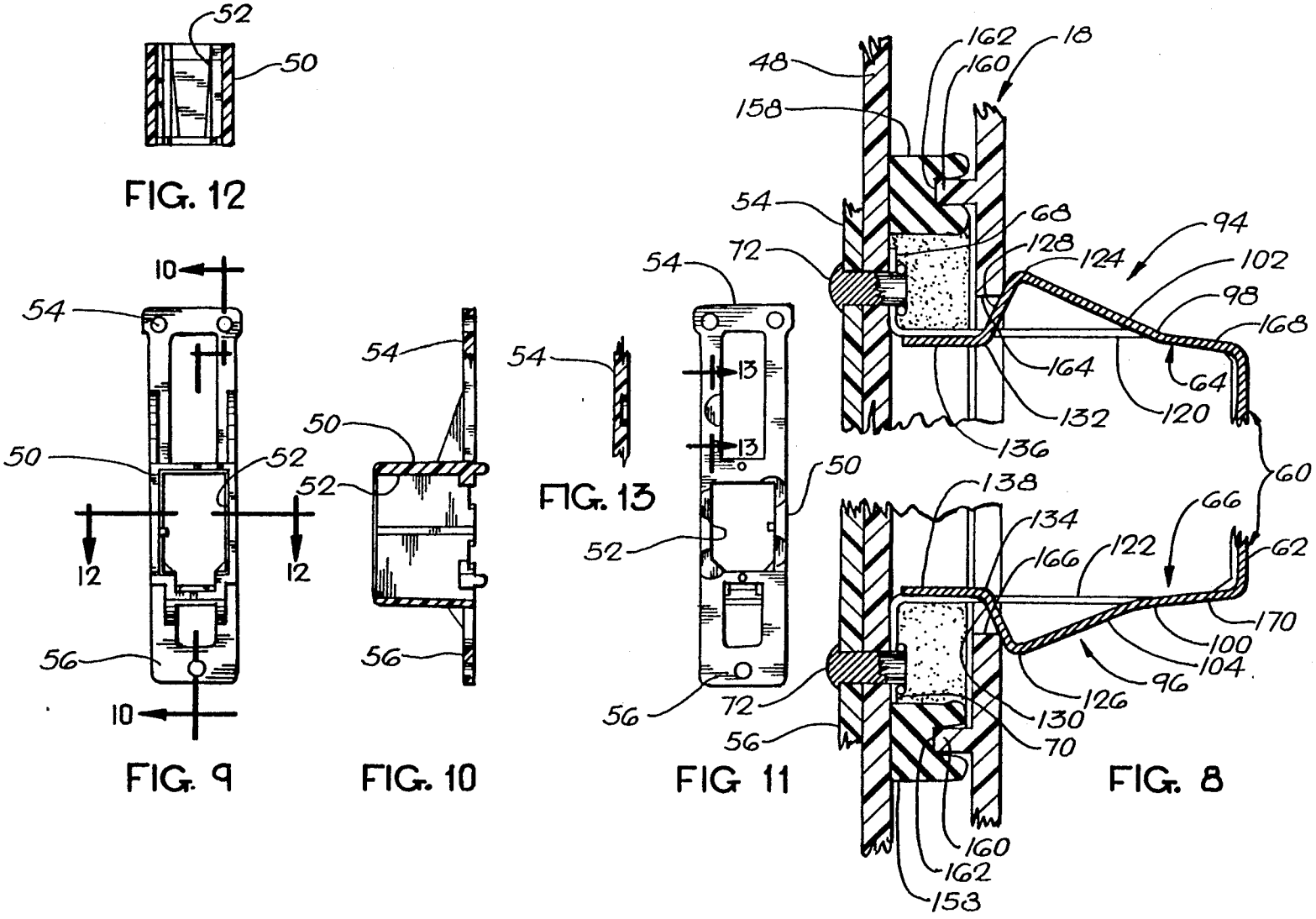
FIG. 8 is a fragmentary enlarged longitudinal section, similar to portions of FIG. 2, but showing the resistor unit mounted on the supporting wall, with a portion of the unit extending through the opening therein.
FIG. 9 is a front elevation of an insulating shell, constituting ,one component of the resistor unit.
FIG. 10 is a generally longitudinal section, taken through the shell of FIG. 9, generally along the broken line 10—10 therein.
FIG. 11 is a rear elevational view of the shell of FIG. 9.
FIG. 12 is a transverse section taken through the shell, generally along the line 12—12 in FIG. 9.
FIG. 13 is fragmentary section, taken generally along the line 13—13 in FIG. 11.
Figure 15:
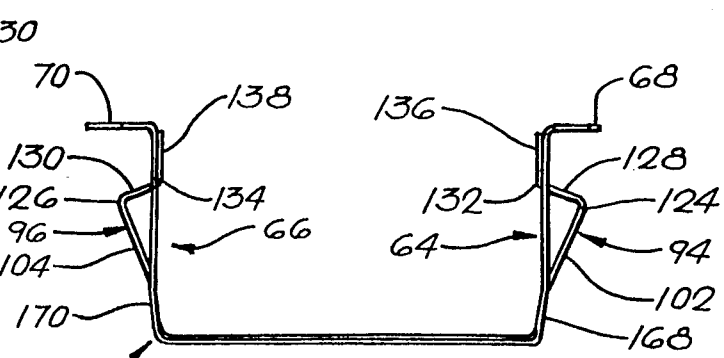
FIG. 15 is a longitudinal side view of the clip.

As shown in FIGS. 8 and 15, the slant angles of the shoulder portions 128 and 130 are inclined oppositely from the slant angles of the ramp portions 102 and 104, relative to the longitudinal directions of the stationary supporting members 120 and 12 of the legs 64 and 66, respectively. At the bend lines 124 and 126, the spring latching members 94 and 96 are bent through approximately 90 degrees so that the shoulder portions 128 and 130 are approximately at right angles to the corresponding ramp portions 102 and 104.

The shoulder portions 128 and 130 of the respective spring latching members 94 and 96 slant inwardly to respective third bend lines 132 and 134 from which front end portions 136 and 138 of the spring latching members 94 and 96 extend forwardly a short distance toward the plane of the mounting flanges 68 and 70 but short of such plane. The front end portions 136 and 138 are substantially parallel with the front portions of the stationary supporting members 120 and 122.

The slant angle of the ramp portions 102 and 104, relative to the longitudinal directions of the legs 64 and 66, is approximately 25 degrees. The angle of the bend at each of the third bend lines 132 and 134 is approximately 115 degrees, which is also the slant angle of the shoulder portions 128 and 130 relative to the corresponding legs 64 and 66.

When the resistor unit 10 is mounted on the wall 18, the mounting clip 60 is inserted through the opening 20 in the wall 18. The rear member 62 of the clip 60 is inserted through the main or widest portion 86 of the opening 20. The first or narrow end portion 82 of the rear member 62 passes through the first or narrow end portion 88 of the opening 20. The second relatively wide end portion 84 of the rear member 62 passes through the second or wide end portion 90 of the opening 20. The second leg 66 of the clip 60 also passes through the relatively wide end portion 90 of the opening 20. The leg 66 is made slightly wider than the width of the end portion 90 so that an interference fit is produced between the leg 66 and the wide opening portion 90. Because of the interference fit, a substantial amount of force must be exerted to push the leg 66 through the opening portion 90. The interference fit may also be characterized as a press fit. The provision of the interference fit obviates any looseness between the leg 66 and the opening portion 90, so that rattling of the leg 66 in the opening portion 90 is prevented.

The first leg 64 of the mounting clip 60 has a width which is substantially the same as the width of the second leg 66. As shown in FIG. 14, the leg 64 has a width which is substantially slightly greater than the width of the first or narrow end portion 82 of the rear member 62 on the clip 60. To accommodate the width of the leg 64, the opening or slot 20 in the wall 18 has a relatively wide opening or slot portion 140 located laterally outwardly of the first or narrow end portion 88 of the opening 20 in the wall 18. The width of the wide opening portion 140 is preferably the same as the width of the wide opening portion 90 at the opposite end of the opening 20. The width of the first leg 64 on the clip 60 is slightly greater than the width of the opening portion 140, to produce an interference or press fit between the leg 64 and the opening portion 140. Thus, a substantial amount of force must be exerted to push the leg 64 through the opening portion 140. The interference fit obviates any looseness between the leg 64 and the opening portion 140, whereby rattling between the leg 64 and the wall 18 is prevented.

Figure 17:
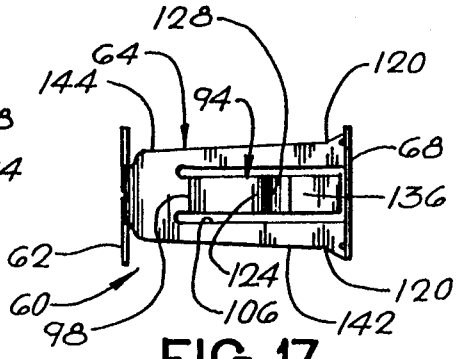
FIGS. 16 and 17 are opposite end views of the clip.

It will be seen from FIG. 17 that the width of the leg 64 is tapered rearwardly between the mounting flange 68 and the rear member 62 of the mounting clip 60. Thus, the leg 64 has a relatively wide portion 142 near the front mounting flange 68 of the leg 64. The interference fit is produced between the wide portion 142 and the opening or slot portion 140. The leg 64 tapers rearwardly at a small acute angle from the relatively wide portion 142 to a relatively narrow portion 144 near the rear member 62 of the clip 60. The relatively narrow rear portion of the leg 64 fits easily into the opening portion 140 in the wall 18.

Similarly, the second leg 66 has a relatively wide portion 146, near the front mounting flange 70, to produce the interference fit with the opening portion 90. The width of the leg 66 tapers rearwardly at a small acute angle to a relatively narrow portion 148 which can be inserted easily through the opening portion 90.

When the mounting clip 60 is inserted through the opening 20 in the wall 18, the first spring latching member 94 of the clip 60 is adapted to be inserted through a first relatively narrow extreme end portion 150 adjacent the opening or slot portion 140. The width of the opening portion 150 is preferably slightly greater than the width of the first spring latching member 94 so that the member 94 is freely slidable into the opening portion 150.

Similarly, the second spring latching member 96 of the mounting clip 60 is freely slidable into a second relatively narrow extreme end portion 152 of the opening 20 at the opposite end thereof from the opening portion 150. The opening portion 152 is adjacent the opening portion 90 and preferably has a width slightly greater than the width of the second spring latching member 96.

Figure 5:
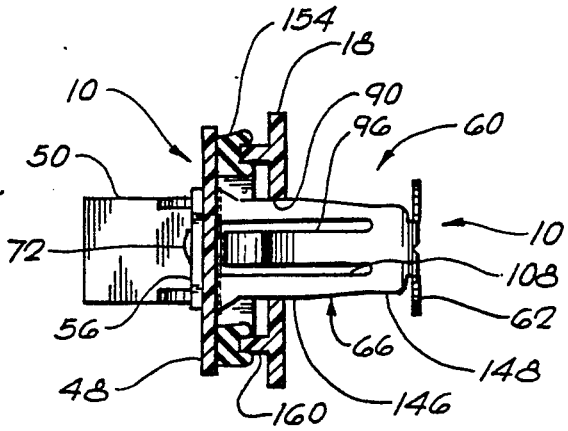
FIG. 5 is a sectional view, taken through the resistor unit and a portion of the supporting wall, generally along the line 5—5 in FIG. 4.
Figure 6:
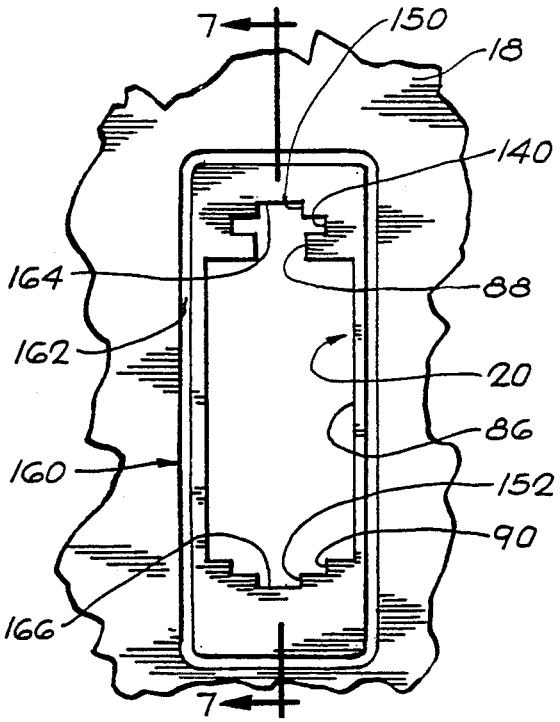
FIG. 6 is a fragmentary front or outside view of a blower wall on which the resistor unit is mounted, the wall having an opening through which a portion of the resistor unit is inserted.
Figure 7:
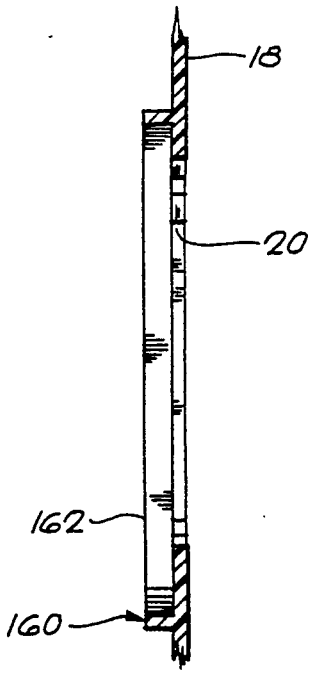
FIG. 7 is a longitudinal section taken through the wall of FIG. 6, generally along the line 7—7 therein.

As shown in FIGS. 5 and 8, the resistor unit 10 is provided with a soft, resilient sealing gasket 154, preferably made of synthetic or natural foam rubber or expanded rubber, such as expanded EPDM rubber "C", S.A.E.- J18 Grade RE-41CZ1Z2.

Figure 3:
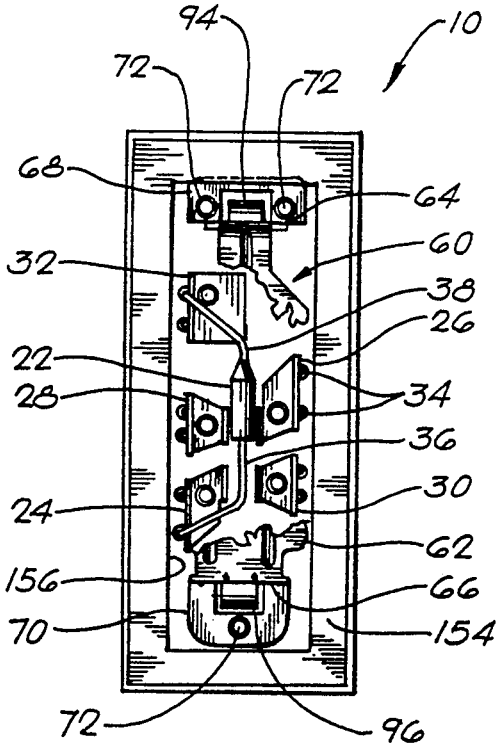
FIG. 3 is a rear elevational view of the resistor unit, with a portion of the guard member broken away, and with the resistors removed for clarity of illustration.
Figure 23:
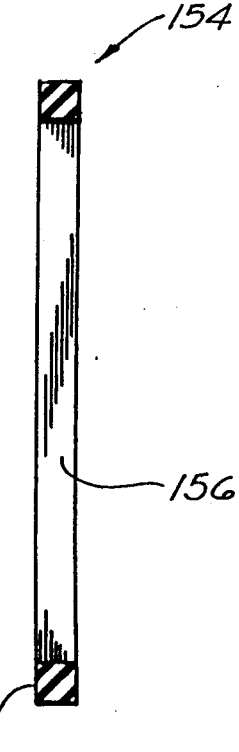
FIG. 23 is a central longitudinal section, taken generally as indicated by the line 23—23 in FIG. 22.
Figure 22:
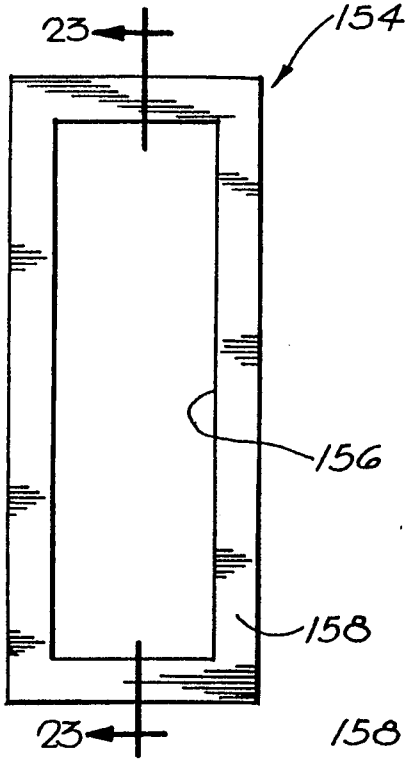
FIG. 22 is an elevational view showing the sealing gasket of the resistor unit.
Figure 20:
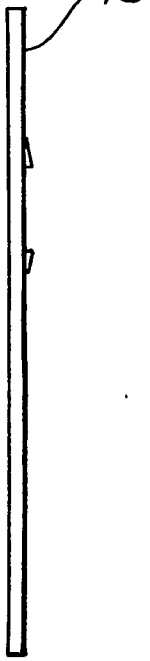
FIGS. 20 and 21 are side and end edge views of the terminal head of FIG. 19.
Figure 19:
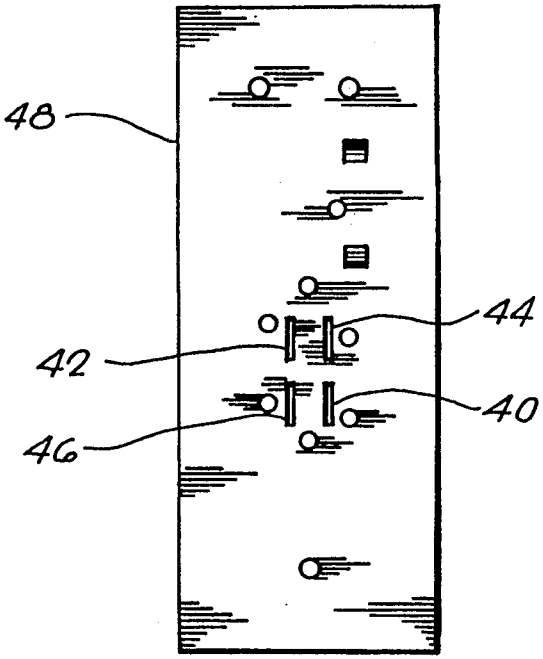
FIG. 19 is an elevational view showing the terminal head or board of the resistor unit.
Figure 21:
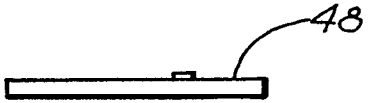

As shown separately in FIGS. 22 and 23, the gasket 154 is generally rectangular in shape and is formed with a generally rectangular opening 156 therein. Pressure sensitive adhesive 158 is preferably applied to one side of the gasket 154, whereby the gasket is secured to the rear side of the terminal head 48, as shown in FIGS. 2 and 3 and also in FIGS. 5 and 8. As shown in FIG. 3, the gasket 154 extends around the terminals 24–30 and the mounting clip 60. The elevational outline of the gasket 154 is only slightly smaller than the elevational outline of the terminal head 48.

When the resistor unit 10 is in its position of use, as shown in FIGS. 5 and 8, the gasket 154 engages the wall 18 and forms a substantially air-tight seal therewith. The illustrated wall 18 is formed with a forwardly projecting, generally rectangular flange or rib 160 for sealing engagement by the gasket 154. The size and shape of the rib 160 corresponds generally to the size and shape of the gasket 154 so that substantially the entire front surface 162 of the rib 160 is engaged by the gasket 154 when the resistor unit 10 is in its position of use. The rib 160 is preferably rectangular in cross section.

As shown to best advantage in FIGS. 5 and 8, the gasket 154 is compressible to a substantial extent by the rib 160. Such compression of the gasket 154 actually takes place when the resistor unit 10 is being installed, and the compression is maintained by the action of the first and second spring latching members 94 and 96. In the process of installation, the installer inserts the mounting clip 60 into the opening or slot 20 in the wall 18, with the resistor unit 10 properly oriented so that the narrow end portion 82 of the rear member 62 will pass through the narrow opening portion 88. The spring latching members 94 and 96 are moved into the respective narrow end portions 150 and 152 of the opening 20 until the ramp portions 102 and 104 engage the edge portions 164 and 166 of the wall 18 at the ends of the respective narrow opening portions 150 and 152. Further insertion of the resistor unit 10 causes the spring latching members 94 and 96 to be flexed laterally inwardly by the camming action between the respective ramp portions 102 and 104 and the edge portions 164 and 166. The gasket 154 comes into engagement with the flange 160 before the ramp portions 102 and 104 pass through the opening portions 150 and 152, so that the installer must compress the gasket 154 sufficiently to enable the spring latching members 94 and 96 to spring laterally outwardly in an abrupt manner, whereby the shoulders 128 and 130 are moved into engagement with the edge portions 164 and 166, as shown in FIG. 8. The abrupt outward movement of the two spring latching members 94 and 96 produces a definite tactile feedback to the hand of the installer, in that the installer will feel two definite thumps when the latching members 94 and 96 spring outwardly. The spring resistance afforded by the latching members 94 and 96 is made very substantial, so as to enhance the tactile feedback. If the installer pushes strongly enough on the resistor unit to latch one of the spring latching members 94 or 96 but not the other, the installer will feel only one thump, which will be the tactile signal to push harder, until the second thump is felt. Moreover, if only one of the spring latching members 94 and 96 is latched, the unlatched end of the resistor unit 10 will spring forwardly to a noticeable extent when the installer starts to release the pushing force on the resistor unit. The forward movement of the unlatched end of the resistor unit is a further tactile signal to the installer to push much harder until both spring latching members 94 and 96 are securely latched.

As shown in FIGS. 8 and 15, the legs 64 and 66 on the mounting clip 60 extend substantially at right angles to the rear panel or member 62 of the clip 60, and perpendicular to the terminal head or plate 48, except that the legs 64 and 66 have respective rear portions 168 and 170 which extend rearwardly and inwardly at a small acute slant angle toward each other to facilitate the entry of the legs 64 and 66 into the opening or slot portions 140 and 90, respectively. By virtue of the slant angles of the rear portions 168 and 170, they fit freely in the opening or slot portions 140 and 90. However, when the legs 64 and 66 are fully inserted into the opening portions 140 and 90, the legs 64 and 66 are in frictional engagement with the wall 18 along the outer boundaries of the opening portions 140 and 90, so as to obviate any looseness or rattling between the wall 18 and the legs 64 and 66.

The shoulder portions 128 and 130 of the respective spring latching members 94 and 96 extend at small acute slant angles relative to the longitudinal dimension of the terminal head plate 48 and also relative to the supporting wall 18, whereby respective wedging actions are produced between the shoulder portions 128 and 130 and the corresponding edge portions 164 and 166 on the supporting wall 18 adjacent the extreme end portions 150 and 152 of the opening 20. The spring force exerted by the resiliently compressed gasket 154 is resisted and counterbalanced by the wedge forces between the slanting shoulder portions 128 and 130 and the edge portions 164 and 166 on the wall 18. The wedging shoulder portions 128 and 130 strongly resist any attempt to pull the mounting clip 60 out of the opening 20 in the wall 18, so that accidental removal of the resistor unit 10 from its position of use on the supporting wall 18 is prevented. The shoulder portions 128 and 130 may also be referred to as retaining ramps. The retention of the resistor unit 10 in its position of use on the wall 18 is so secure that the mounted position of the resistor unit 10 will not be disturbed by removal of the electrical connector (not shown) from the forwardly projecting terminal prongs **24*a*, 26*a*, 28*a* and 30*a*. It will be noted that the rivets 72, extending between the shell 50 and the mounting clip 60, are aligned and symmetrical with respect to both the shell 50 and the mounting clip 60, so that any pulling force, however strong, exerted on the electrical connector, or on the electrical wires (not shown) connected thereto, will be transmitted directly and evenly to the mounting clip 60. In this way, any such pulling force will have virtually no chance of causing the disconnection of the mounting clip 60 from the supporting wall 18. The resistor unit 10 has a very long useful life, so that removal of the resistor unit 10 from the wall 18** for maintenance or replacement is very rarely necessary.

The spring force exerted by the resiliently compressed gasket 154 and the counterbalancing forces exerted by the wedging shoulder portions 128 and 130 of the spring latching members 94 and 96 obviate any looseness or rattling of the resistor unit 10 relative to the wall 18. If the necessity ever arises to remove the resistor unit 10 from the supporting wall 18, one of the spring latching members 94 and 96 can be released by forcing a thin sharp blade or other tool between the rubber gasket 154 and the rear side of the terminal head or plate 48 whereupon the blade can be moved into engagement with one of the front end portions 136 and 138 of the spring latching members 94 and 96. The blade can then be used to force one of the spring latching members 94 and 96 laterally inwardly until the corresponding shoulder portion 128 or 130 is no longer in latching engagement with the supporting wall 18, whereupon the corresponding end of the terminal head or plate 48 can be pulled forwardly. The blade can then be withdrawn and used in a similar manner to release the other of the spring latching members 94 and 96 from its latching engagement with the wall 18.

Various modifications, alternative constructions and equivalents may be employed, without departing from the true spirit and scope of the invention, as exemplified in the preceding description and defined in the following claims.

I claim:

1. A resistor unit for regulating the speed of an automotive blower motor, said resistor unit comprising an insulating terminal head plate, a plurality of electrical terminals mounted on the rear side of said plate, at least some of said terminals having prongs extending forwardly from said plate for establishing electrical connections to said terminals, a plurality of resistors connected between said terminals and disposed to the rear of said plate, and a generally U-shaped mounting clip secured to the rear side of said plate and made of flexible resilient spring sheet metal, said clip partially surrounding said resistors and providing a guard for said resistors, said clip having a rear member generally parallel with said plate and spaced to the rear of said plate, said clip having first and second legs bent forwardly from opposite ends of said rear member, said legs having means for securing the front ends of said legs to said plate, said clip including first and second spring latching members formed in one piece with said first and second legs and struck from the sheet metal thereof, said spring latching members having ramp portions bent laterally outwardly from said legs near the rear ends thereof and slanting laterally outwardly at small acute angles from said legs, said legs having longitudinal slots therein resulting at least in part from the striking of said spring latching members from said legs, said first and second spring latching members having first and second shoulder portions bent inwardly at slant angles from the front ends of said ramp portions, the respective shoulder portions extending inwardly through the corresponding longitudinal slots in said legs.

2. A resistor unit according to claim 1, said first and second spring latching members having respective first and second front end portions bent forwardly from the corresponding shoulder portions and extending generally parallel with said legs.

3. A resistor unit according to claim 1, including a soft resilient compressible gasket mounted on the rear side of said terminal head plate and extending around said terminals and said mounting clip.

4. A resistor unit according to claim 1, in which said first and second shoulder portions are bent at substantially right angles relative to the respective ramp portions, said first and second shoulder portions extending at small acute slant angles relative to the direction of said terminal head plate.

5. A resistor unit according to claim 1, in which said first and second legs of said clip are tapered rearwardly between said terminal head plate and said rear member of said mounting clip.

6. A resistor unit according to claim 1, in which said first and second legs are substantially perpendicular to said terminal head plate and substantially parallel to each other, except that said first and second legs have rear portions which slant rearwardly and inwardly toward each other at a small acute angle.

7. A resistor unit according to claim 1, in which said rear member of said clip is nonsymmetrical and has a wide main portion and first and second end portions of different widths, said first end portion having a narrow width which is substantially narrower than the width of said main portion, said second end portion having a substantially wider width than the width of said narrow first end portion.

8. A resistor unit according to claim 7, in which said first and second legs connect with the respective first and second end portions of said rear member, said first and second legs having widths which are substantially the same.

9. A resistor unit in combination with a supporting wall for said resistor unit, said resistor unit comprising an insulating terminal head plate, a plurality of electrical terminals mounted on the rear side of said plate, at least some of said terminals having prongs extending forwardly from said plate for establishing electrical connections to said terminals, a plurality of resistors connected between said terminals and disposed to the rear of said plate, and a generally U-shaped mounting clip secured to the rear side of said plate and made of flexible resilient spring sheet metal for securely connecting said resistor unit to said supporting wall, said supporting wall having a generally rectangular opening therein for receiving said resistors and said mounting clip, said clip partially surrounding said resistors and providing a guard for said resistors, said clip having a rear member generally parallel with said plate and spaced to the rear of said plate, said clip having first and second legs bent forwardly from opposite ends of said rear member, said legs having means for securing the front ends of said legs to said plate, said rear member being nonsymmetrical in shape, said opening in said wall having a corresponding nonsymmetrical shape for receiving said rear member in a unique orientation, said clip including first and second spring latching members formed in one piece with said first and second legs and struck from the sheet metal thereof, said first and second spring latching members having respective first and second ramp portions bent laterally outwardly from said legs near the rear ends thereof and slanting laterally outwardly at small acute angles from said legs, said legs having longitudinal slots therein resulting at least in part from the striking of said spring latching members from said legs, said first and second spring latching members having first and second shoulder portions bent inwardly from the front ends of said ramp portions at small acute slant angles relative to the longitudinal direction of said plate, the respective shoulder portions extending inwardly through the corresponding longitudinal slots in said legs, said opening in said supporting wall having first and second extreme end portions of a reduced width corresponding with the width of said spring latching members for receiving said spring latching members, said wall having first and second edge portions adjacent said first and second extreme end portions of said opening for engagement by said spring latching members, said first and second spring latching members being flexed inwardly by camming action between said ramp portions and said edge portions when said clip is inserted rearwardly through said opening in said wall, said shoulder portions being engageable with said edge portions in response to further inserting movement of said clip into said opening for securely retaining said clip in said opening.

10. The combination according to claim 9, in which said shoulder portions extend at small acute slant angles relative to said wall for producing a wedging action between each of said shoulder portions and the corresponding edge portion on said wall.

11. The combination according to claim 10, in which said resistor unit includes a soft resilient compressible gasket on said plate and compressible by engagement with said wall, the compression of said gasket producing a resilient force counterbalanced by the wedging action of said shoulder portions for preventing looseness and rattling of said resistor unit relative to said supporting wall.

12. The combination according to claim 11, in which said supporting wall includes a rib projecting forwardly from said wall and extending around said opening for sealing engagement with said gasket to compress said gasket.

13. The combination of claim 11, in which said gasket is made of expanded rubber.

14. The combination according to claim 11, in which said first and second shoulder portions are bent at substantially right angles relative to the respective ramp portions, said first and second shoulder portions extending at small acute slant angles relative to the direction of said terminal head plate to produce a wedging action between said shoulder portions and the edge portions on said wall.

15. The combination according to claim 11, in which said opening in said supporting wall includes first and second opening portions adjacent said extreme end portions of said opening, said first and second legs of said clip being receivable in said first and second opening portions with an interference fit between each leg and the corresponding opening portion to prevent looseness and rattling of said legs relative to said supporting wall.

16. The combination according to claim 15, in which each of said legs has a front portion with a width slightly greater than the width of the corresponding opening portion to produce the interference fit therewith, said first and second legs of said clip being tapered rearwardly in width to provide for easy entry of said first and second legs into said first and second opening portions.

17. The combination according to claim 16, in which said first and second legs are substantially perpendicular to said terminal head plate and substantially parallel to each other, except that said first and second legs have rear portions which slant rearwardly and inwardly toward each other at a small acute angle, said rear portions of said legs being freely receivable in said opening portions, said legs being positioned to produce frictional engagement between each of said legs and the supporting wall adjacent said opening portions when said legs are fully inserted into said opening portions.

18. The combination according to claim 16, in which said rear member of said clip has a wide main portion and first and second end portions of different widths, said first end portion of said rear member having a narrow width which is substantially narrower than the width of said main portion, said opening in said supporting wall having a narrow portion of a width corresponding with the width of said first end portion of said rear member for receiving said first end portion of said rear member, said second end portion of said rear member having a substantially wider width than the width of said narrow first end portion of said rear member, said opening in said supporting wall having a relatively wide opening portion of a width corresponding with the width of said second end portion of said rear member for receiving said second end portion of said rear member, whereby said rear member is receivable in a unique orientation in said opening in said supporting wall.

19. A resistor unit according to claim 1, in which each of said longitudinal slots is substantially wider than the corresponding spring latching member to afford ample clearance therebetween.

20. A resistor unit in combination with a supporting wall for said resistor unit, said resistor unit comprising an insulating terminal head plate, a plurality of electrical terminals mounted on the rear side of said plate, at least some of said terminals having prongs extending forwardly from said plate for establishing electrical connections to said terminals, a plurality of resistors connected between said terminals and disposed to the rear of said plate, and a generally U-shaped mounting clip secured to the rear side of said plate and made of flexible resilient spring sheet metal for securely connecting said resistor unit to said supporting wall, said supporting wall having a generally rectangular opening therein for receiving said resistors and said mounting clip, said clip partially surrounding said resistors and providing a guard for said resistors, said clip having a rear member generally parallel with said plate and spaced to the rear of said plate, said clip having first and second legs bent forwardly from opposite ends of said rear member, said legs having means for securing the front ends of said legs to said plate, said rear member being nonsymmetrical said opening in said wall having a corresponding nonsymmetrical shape for receiving said rear member in a unique orientation, said clip including first and second spring latching members formed in one piece with said first and second legs and struck from the sheet metal thereof, said first and second spring latching members having respective first and second ramp portions bent laterally outwardly from said legs near the rear ends thereof and slanting laterally outwardly at small acute angles from said legs, said legs having longitudinal slots therein resulting in part from the striking of said spring latching members from said legs, said longitudinal slots being substantially wider than said spring latching members to afford ample clearance for movement of said spring latching members in said slots, said first and second spring latching members having first and second shoulder portions bent inwardly from the front ends of said ramp portions at small acute slant angles relative to the longitudinal direction of said plate, the respective shoulder portions extending inwardly through the corresponding longitudinal slots in said legs, said opening in said supporting wall having first and second extreme end portions of a reduced width corresponding with the width of said spring latching members for receiving said spring latching members, said wall having first and second edge portions adjacent said first and second extreme end portions of said opening for engagement by said spring latching members, said first and second spring latching members being flexed inwardly by camming action between said ramp portions and said edge portions when said clip is inserted rearwardly through said opening in said wall, said shoulder portions being engageable with said edge portions in response to further inserting movement of said clip into said opening for securely retaining said clip in said opening, said shoulder portions extending at small acute slant angles relative to said wall for producing a wedging action between each of said shoulder portions and the corresponding edge portion on said wall, said resistor unit including a soft resilient compressible gasket on said plate and compressible by engagement with said wall, the compression of said gasket producing a resilient force counterbalanced by the wedging action of said shoulder portions for preventing looseness and rattling of said resistor unit relative to said supporting wall.

21. The combination according to claim 20, in which said supporting wall includes a rib projecting forwardly from said wall and extending around said opening for sealing engagement with said gasket to compress said gasket.

* * * * *